United States Patent [19]

Kockler et al.

[11] 4,111,293

[45] Sep. 5, 1978

[54] RIBBON TRANSPORTING AND SHIFTING MECHANISM

[75] Inventors: Barry C. Kockler, Lewisville, Tex.; Ronald L. Beaty, Moses Lake, Wash.

[73] Assignee: Xerox Corporation, Stamford, Conn.

[21] Appl. No.: 758,380

[22] Filed: Jan. 10, 1977

[51] Int. Cl.[2] ..... B41J 33/58

[52] U.S. Cl. ..... 400/208; 400/213; 197/144.2; 400/320; 400/335; 400/568; 400/902; 400/322

[58] Field of Search ..... 197/16, 151, 157, 158, 197/159, 82, 114 R, 53

[56] References Cited

U.S. PATENT DOCUMENTS

| | | | |
|---|---|---|---|
| 835,509 | 11/1906 | Felbel | 197/158 |
| 878,574 | 2/1908 | Steele | 197/157 |
| 879,159 | 2/1908 | Fox | 197/157 |
| 3,261,445 | 7/1966 | Hickerson | 197/16 X |
| 3,513,957 | 5/1970 | Ricciardi et al. | 197/151 |
| 3,531,592 | 9/1970 | Sandrone | 197/157 X |
| 3,871,507 | 3/1975 | Perry et al. | 197/158 X |
| 3,904,015 | 9/1975 | Boyden et al. | 197/151 |
| 4,020,940 | 5/1977 | Daley et al. | 197/151 |

FOREIGN PATENT DOCUMENTS

| | | | |
|---|---|---|---|
| 2,306,836 | 11/1976 | France | 197/151 |
| 2,337,626 | 4/1974 | Fed. Rep. of Germany | 197/151 |

OTHER PUBLICATIONS

IBM Technical Disclosure Bulletin, "Ribbon Cartridge", R. D. Mathews, vol. 18, No. 11, Apr. 1976, p. 3538.

*Primary Examiner*—Ernest T. Wright, Jr.

[57] ABSTRACT

To more fully utilize the surface area of a typewriter ribbon in a cartridge ribbon receptacle, the cartridge locating plate supporting the receptacle is caused to oscillate with respect to the print head assembly. The ribbon cartridge assembly is a part of a print head and ribbon carrier that is positionable along a line of print by a drive motor through a belt drive engaging a drive pulley rotatably mounted to the carrier. Mounted to rotate with the drive pulley is a cam that engages a cam follower also mounted to the head and ribbon carrier. An upstop forms a part of the cam follower and engages the cartridge locating plate. With the cam follower driven by the cam, an oscillating motion is imparted to the upstop with reference to the head and ribbon carrier which motion is then imparted to the cartridge locating plate. Also fastened to the head and ribbon carrier is a solenoid that when energized spring biases the cartridge locating plate through a leaf spring attached to the plate.

8 Claims, 7 Drawing Figures

RIBBON TRANSPORTING AND SHIFTING MECHANISM

BACKGROUND OF THE INVENTION

This invention relates to a ribbon transporting and shifting mechanism for a typewriter, and more particularly to ribbon shifting mechanism imparting an oscillatory motion to a ribbon as it is moved past a print head.

Various commercially available typewriters and other data printing machines are provided with a mechanism to impart a vibratory motion to the ribbon feed mechanism as the ribbon moves past a print head. The vibratory motion imparted to the ribbon feed mechanism is characterized by various height positions controlled during successive printing steps from a normal position into which the mechanism drops back after each step is completed. Such a vibratory motion achieves the maximum use from a ribbon and also achieves high quality print characters that are otherwise not obtainable. As each character is typed it may overlap partially the area engaged by the type element during the typing of the preceding character, but not such an overlap as to degrade a high quality print. The transverse motion produced by vibrating the ribbon feed mechanism is such that substantially the full width of the ribbon is subject to the action of the type elements.

While it has been early recognized that improved character print quality could be achieved by vibrating the ribbon feed mechanism, it has only more recently been understood that a still further improvement in print quality was possible when the consecutive points on a ribbon which are struck by a type element are longitudinally and vertically displaced relative to each other so as to define a repetitive wavy pattern running longitudinally along the ribbon. However, even such a defined repetitive pattern leaves a considerable amount of unused surface area on the ribbon; that is, surface area which is not struck by any of the type elements.

SUMMARY OF THE INVENTION

In accordance with the present invention, high quality print characters are obtained by imparting an oscillatory motion to the ribbon as it moves longitudinally past a print element. The oscillatory motion, while itself being repetitive, imparts a somewhat random motion pattern to the ribbon that provides for utilization of substantially all of the surface area. With the mechanism of the present invention, for a complete unwinding of the ribbon from a feed spool to a take-up spool, the type element images will have been distributed as closely as possible over the entire ribbon surface, that is, with a minimum of unused ribbon surface remaining. By imparting an oscillatory motion to the ribbon feed mechanism the images will be distributed randomly over the ribbon surface area to provide both high quality print characters and efficient ribbon utilization.

In accordance with the present invention, a ribbon transporting and shifting mechanism for a typewriter having a print head and ribbon carrier positionable along a line of printing by drive motor includes a ribbon carriage assembly pivotally mounted to the carrier. Mounted to the head and ribbon carrier is a cam that is actuated by the drive motor. A cam follower, also mounted to the ribbon and head carrier, includes an upstop extending from one end of the follower. The cam follower is driven by the cam to impart an oscillatory motion to the upstop with reference to the head and ribbon carrier. Attached to the carriage assembly is a cartridge lift that positions a cartridge locating plate against the upstop of the cam follower such that the oscillatory motion of the upstop is imparted to the carriage assembly as the print head and ribbon carrier is positionable along the line of printing.

BRIEF DESCRIPTION OF THE DRAWING

A more complete understanding of the invention and its advantages will be apparent from the following description of the preferred embodiment of the invention, as illustrated in the accompanying drawing.

Referring to the drawing.

DESCRIPTION OF THE PREFERRED EMBODIMENT

Figure 1:
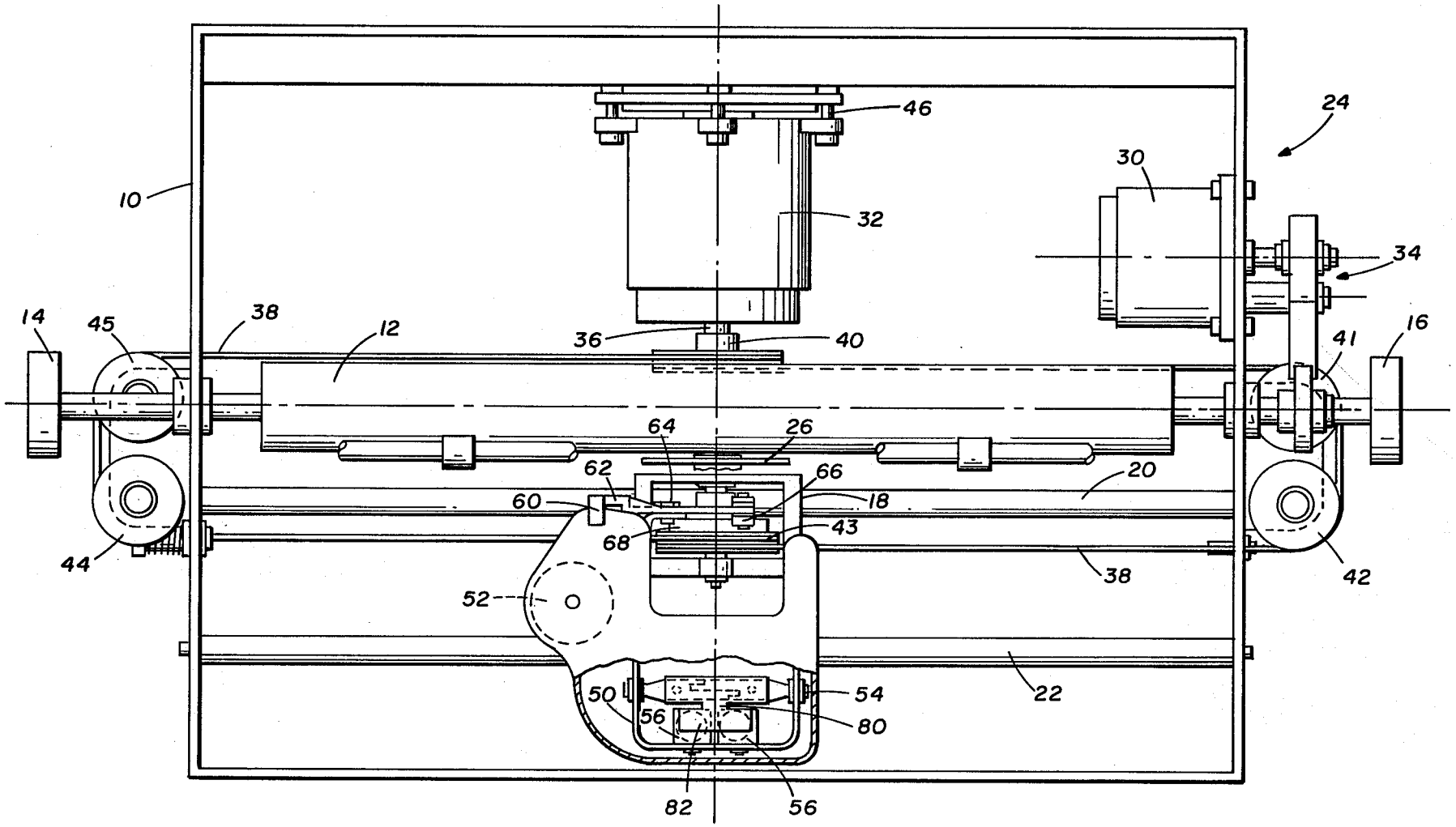
FIG. 1 is a top plan view of a typewriter print assembly embodying the present invention.

Referring now to the drawing and more particularly to FIG. 1, an overall view of the printer 24 embodying the present invention is illustrated. Mounted on a base frame 10 is a platen 12 with knobs 14 and 16 for rolling the platen 12 and the paper record medium (not shown) wrapped thereon. A head and ribbon carrier including a carriage 18 is mounted for linear longitudinal movement on the carriage mounting rails 20 and 22 bridged between opposed sidewalls of the base frame 10 of the printer 24. Carriage 18 supports a print mechanism including a rotary print wheel 26 on which are a number of type elements or character slugs. Also supported on the carriage 18 is a hammer-type impact printing mechanism (not shown) for striking a selected type element and a cartridge locating plate 50 for supporting a ribbon cartridge (not shown) having an inked ribbon (not shown) interposed between the paper on the platen 12 and the type element on the print wheel 26 located at the print position or station.

Furthermore, there are a stepping motor 30 and a servomotor 32 mounted on the base frame 10. The stepping motor 30 is coupled to the platen 12 by a gear train 34 so that the platen 12 is indexed when the motor 30 is activated to incrementally advance the paper through the printer 24. The servomotor 32, on the other hand, has one end of its drive shaft 36 coupled to the carriage 18 by a cable 38, which is trained around a series of pulleys 40–45, and the other end of its drive shaft 36 coupled to a shaft encoder 46. Thus, the carriage 18 is moved to translate the print wheel 26 lengthwise of the platen 12 when the servomotor 32 is actuated, while the encoder 46 supplies a signal which is representative of the actual position of the carriage 18 at any given time.

Figure 2:
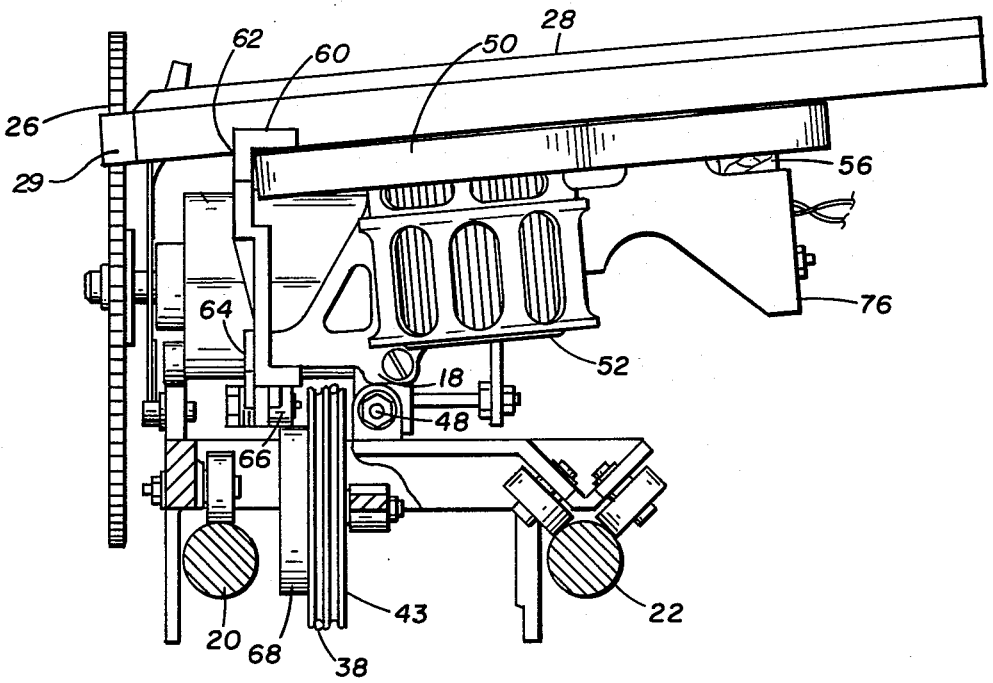
FIG. 2 is a right side plan view of the print head and ribbon carrier of FIG. 1 embodying the present invention with the ribbon containing cartridge installed.
Figure 3:
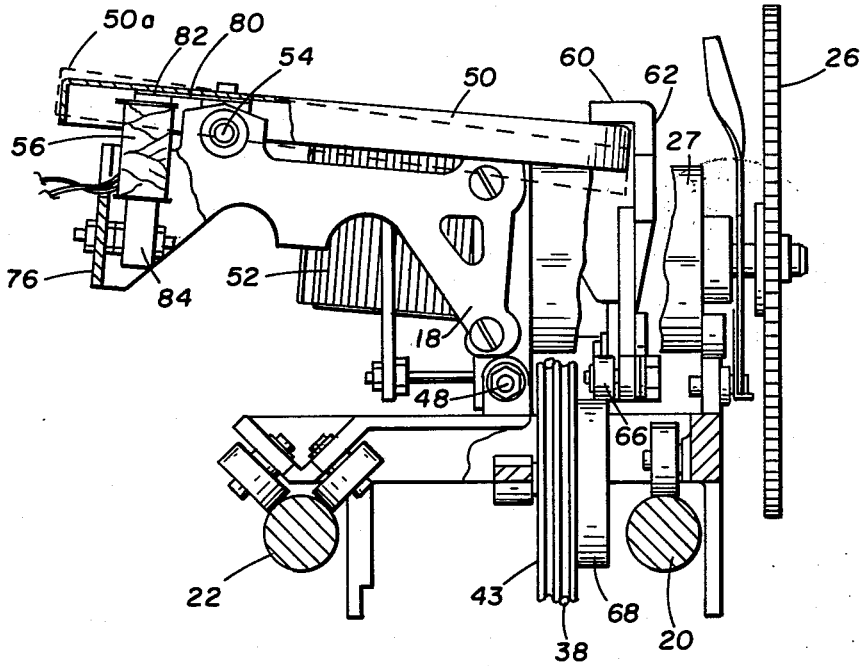
FIG. 3 is a left side plan view of the print head and ribbon carrier of FIG. 1.
Figure 4:
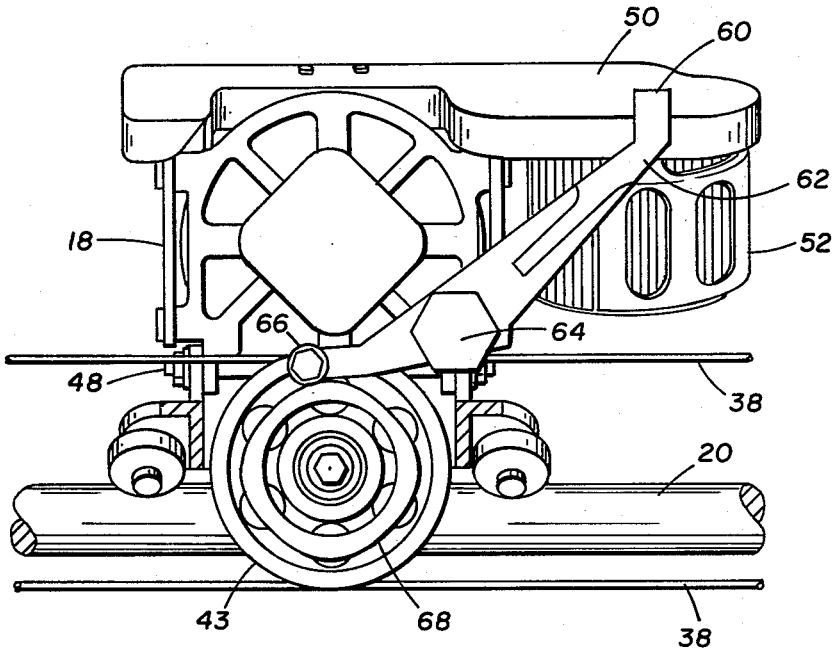
FIG. 4 is a front elevational view of the head and print carrier of FIG. 1 with the print wheel removed.

With reference to FIGS. 2, 3 and 4, and the printer carriage 18 mounted for linear movement on the mounting rails 20 and 22, as typing of the printed characters occurs, the carriage 18 stops each time a character is to be printed. Also, while the carriage 18 is moving from one location to the next location along rails 20 and 22 by movement of cable 38, the print wheel 26 is rotated by means of a servomotor 27 such that the next character to be printed will be in position at the print position when the carriage 18 stops. As seen in FIGS. 2 and 3, the upper portion of the head and ribbon carrier, that is, the carriage 18 is pivotable clockwise about shaft 48 with respect to the lower portion below the carriage 18. This pivoting motion is necessary in order to bring the print wheel 26 up into a position such that the print wheel 26 may be exchanged for a different print wheel 26.

The ribbon cartridge mounting plate 50 is a part of a ribbon cartridge assembly and provides the mounting structure for the ribbon cartridge 28, in FIG. 2, and a ribbon advance motor 52. The ribbon cartridge mounting plate 50 is pivotable counter-clockwise, in FIG. 3, about shaft 54. This pivoting motion is necessary to raise the ribbon 29 from the down position, which is the position that allows the printed material to be viewed by the typist, to an up position at the print station when printing is to occur. The force to pivot the ribbon cartridge mounting plate 50 is a magnetic force supplied by electromagnetic coils 56. When coils 56 are energized a leaf spring 80 having an armature 82 at one end and attached at the other end to the ribbon cartridge mounting plate 50 is drawn down toward the coils 56 thereby spring biasing that portion of the ribbon cartridge 28 which is nearest the print wheel 26 to the print position against an upstop 60 at one end of a follower arm 62.

With particular reference to FIG. 4, the follower arm 62 is pivotally mounted to the carriage 18 on a shaft 64. At the end of the follower arm 62 opposite the upstop 60 there is rotatably mounted a bearing 66 that rotates in contact with the camming surfaces of a cam 68. The cam 68 is formed as an integral part of the drive pulley 43 and rotates therewith by means of the cable 38.

As best illustrated in FIGS. 2 and 3, the upstop 60 extends at right angles to the follower arm 62 over the top surface of the cartridge mounting plate 50 and thereby establishes the upper travel limit of the mounting plate 50 about the shaft 54.

Figure 5:
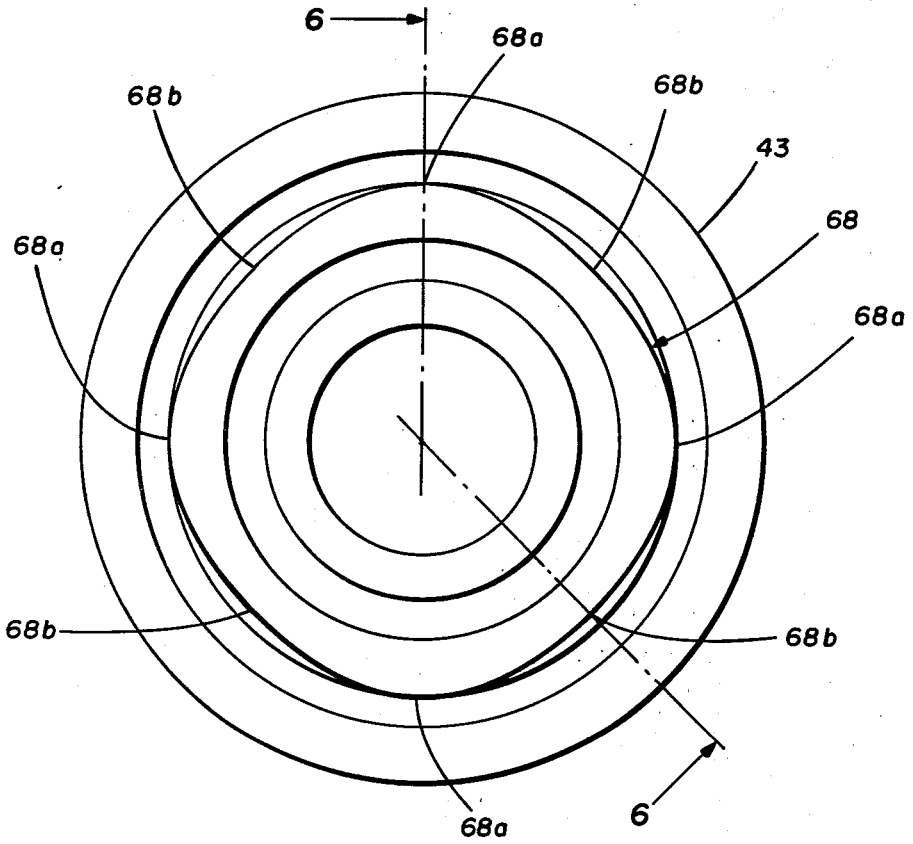
FIG. 5 is a front plan view of a drive pulley and cam assembly mounted to the print head and ribbon carrier of FIG. 1.
Figure 6:
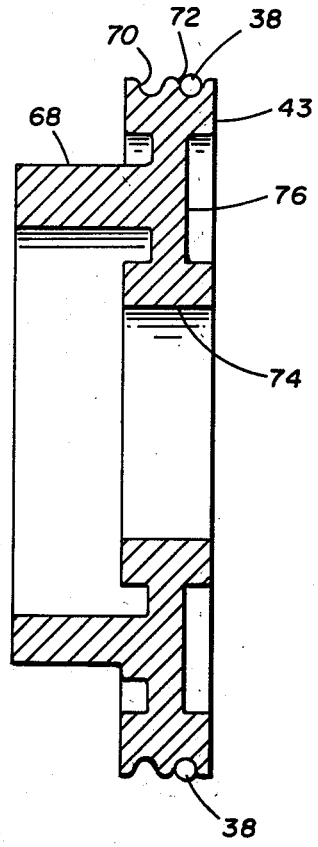
FIG. 6 is a side sectional view of the drive pulley and cam assembly of FIG. 5 taken along the line 6—6 of FIG. 5.

Referring to FIGS. 5 and 6, there is shown a detail of the pulley 43 with the cam 68 formed as an integral part thereof. Cut into the outer circumference of the pulley 43 are grooves 70 and 72 for guiding the cable 38 to impart rotary motion to the pulley 43 about a bearing (not shown) fitted into an aperture 74. The pulley 43 is mounted to the lower part of the head and ribbon assembly which is moved in a longitudinal motion along a line of printing. This longitudinal motion is produced by operation of the servomotor 32 through the pulleys 40–45.

Extending from a web 76 of the pulley 43 is the cam 68 having four high camming surfaces **68*a* and four low camming surfaces 68*b*. As the pulley 43 rotates by means of the servomotor 32, the roller 66 follows the high and low camming surfaces 68*a* and 68*b*, respectively, of the cam 68 to cause the follower arm 62 to oscillate about the shaft 64. This oscillating motion is transmitted to the upstop 60 whereby the upstop 60 oscillates between a high and low position with reference to the carriage 18 as determined by the high and low camming surfaces 68*a* and 68*b*, respectively, of the cam 68**.

Figure 7:
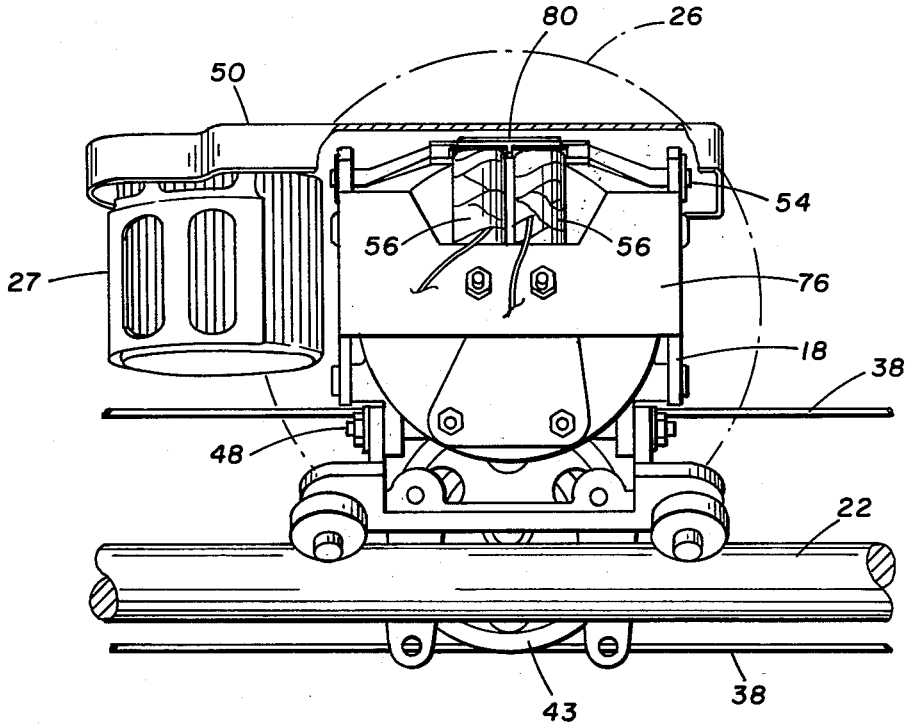
FIG. 7 is a rear elevational view of the print head and ribbon carrier showing a solenoid actuator for a cartridge locating plate to bias the plate relative to the carrier.

Referring to FIGS. 3 and 7, the electromagnetic coils 56 for pivoting the cartridge mounting plate 50 about the shaft 54 are mounted on a support plate 76 as part of the carriage 18. The ribbon cartridge mounting plate 50 has attached thereto one end of a leaf spring 80 terminating at the opposite end in an armature 82 that is in alignment with an iron core 84 of the electromagnetic coils 56.

In the normal operating position, the ribbon cartridge mounting plate 50 rests on structure of the carriage 18 as shown by the dotted outline **50*a* of FIG. 3. Energizing the magnetic coils 56 draws the armature 82 to the iron core 84 thereby holding one end of the leaf spring 80 fixed with respect to the carriage 18 and a second end of the spring 80 fixed in relationship to the mounting plate 50. This spring 80 biases the mounting plate 50 to produce a counter-clockwise rotation, FIG. 3, about the shaft 54 with the maximum rotation limited by the upstop 60**.

In operation of the ribbon transport and shifting mechanism of the present invention, as the servomotor 32 positions the carriage 18 along a line of printing, the cam 68 rotates with the drive pulley 43 to rotate the follower arm 62 about the shaft 64. This movement of the follower arm 62 is translated into an oscillating motion at the upstop 60 with reference to the carriage 18.

At the same time, energizing the electromagnetic coils 56 spring biases the ribbon cartridge mounting plate 50 against the upstop 60. Thus, as the upstop 60 oscillates with respect to the carriage 18, the cartridge mounting plate 50 pivots about the shaft 54 in accordance with the camming surfaces **68*a* and 68*b* of the cam 68. With the ribbon cartridge 28 mounted on the cartridge mounting plate 50, this oscillating motion is imparted to the ribbon 29, in FIG. 3, exposed to a type element on the print wheel 26**.

By designing the cam 68 as illustrated in FIG. 5, each time a new type element is struck a different area of the ribbon is utilized. Areas of the ribbon struck by a type element may, however, overlap, again as determined by the configuration of the camming surfaces **68*a* and 68*b* of the cam 68. Whether the areas overlap is determined by the type of ribbon being utilized. Thus, by selecting a particular outline for the camming surfaces 68*a* and 68*b* of the cam 68**, the ribbon transporting and shifting mechanism of the present invention may be utilized for various different types of ribbons used in typewriters or other print machines.

While the principles of the invention have been made clear in the illustrative embodiment, it is apparent that alternatives, modifications and variations will be evident to those skilled in the art. Accordingly, it is intended to embrace all alternatives, modifications and variations as fall within the spirit and broad scope of the appended claims.

What is claimed is:

1. A ribbon transporting and shifting mechanism for a typewriter having a print head and ribbon carrier positionable along a line of printing by a drive motor, and a ribbon cartridge assembly pivotally mounted on the carrier, comprising:

a cam mounted on the head and ribbon carrier and actuated by the drive motor, a cam follower mounted on the head and ribbon carrier and including an upstop, said cam follower driven by said cam to oscillate the position of the upstop with reference to the head and ribbon carrier, and cartridge lift means coupled to the cartridge assembly for positioning thereof against the upstop of said cam follower, said lift means includes a solenoid attached to said carrier and a spring fastened to the cartridge assembly and held in contact with said solenoid when energized to resiliently bias the cartridge assembly against the upstop.

2. A ribbon transporting and shifting mechanism as set forth in claim 1 wherein said cam is a part of a drive pulley that is belt driven by the drive motor.

3. A ribbon transporting and shifting mechanism as set forth in claim 1 wherein said cam follower includes a follower arm pivotally mounted on the carrier and having one end in contact with said cam and the other end terminating in the upstop.

4. A ribbon transporting and shifting mechanism as set forth in claim 1 wherein said cam is part of a drive pulley and includes multiple high and low camming surfaces to produce a plurality of oscillations of the upstop for each rotation of the drive pulley.

5. A ribbon transporting and shifting mechanism for a typewriter having a print head and ribbon carrier positionable along a line of printing by drive means, comprising:

a ribbon cartridge assembly including a cartridge locating plate pivotally mounted on the carrier and supporting a ribbon containing receptacle for positioning a ribbon in different positions with respect to a print wheel, a drive pulley rotatably mounted on the carrier as part of the drive means, a cam rotatable with said drive pulley, a cam follower mounted on the head and ribbon carrier and including an upstop, said cam follower driven by said cam to oscillate the position of the upstop with reference to the head and ribbon carrier, and cartridge lift means resiliently coupling the cartridge locating plate to a print head and ribbon assembly for positioning the locating plate against the upstop of said cam follower.

6. The ribbon transporting and shifting mechanism as set forth in claim 5 wherein said cam has multiple high and low camming surfaces to produce a plurality of oscillations of the upstop for each rotation of the drive pulley.

7. A ribbon transporting and shifting mechanism as forth in claim 5 wherein said cam follower includes a follower arm pivotally mounted on the carrier and having one end terminating in a roller for contact with said cam and the other end terminating in the upstop.

8. A ribbon transporting and shifting mechanism as set forth in claim 5 wherein said cartridge lift means includes a spring fastened at one end to the cartridge locating plate and terminating at the opposite end in an armature, and a solenoid attached to the carrier whereby energizing said solenoid holds the armature in contact therewith to resiliently bias the cartridge assembly against the upstop.

* * * * *